US005676455A

United States Patent [19]

Johnson et al.

[11] Patent Number: 5,676,455

[45] Date of Patent: Oct. 14, 1997

[54] WALL MOUNTABLE LIGHTING FIXTURE

[75] Inventors: Dennis E. Johnson; Dean R. Smith, both of Grafton, Wis.

[73] Assignee: SPI Lighting, Inc., Mequon, Wis.

[21] Appl. No.: 551,386

[22] Filed: Nov. 1, 1995

[51] Int. Cl.[6] ..... F21V 7/00

[52] U.S. Cl. ..... 362/301; 362/346; 362/348; 362/349

[58] Field of Search ..... 362/298, 301, 362/302, 304, 346, 349, 147, 348

[56] References Cited

U.S. PATENT DOCUMENTS

| | | | |
|---|---|---|---|
| 1,642,339 | 9/1927 | Kast . | |
| 4,188,657 | 2/1980 | Reibling | 362/348 |
| 4,344,111 | 8/1982 | Ruud et al. | 362/33 |
| 4,472,767 | 9/1984 | Wenman | 362/302 |
| 4,575,783 | 3/1986 | Hammond | 362/145 |
| 4,575,788 | 3/1986 | Lewin | 362/346 |
| 4,731,714 | 3/1988 | Kelly et al. | 362/310 |
| 5,379,199 | 1/1995 | Hirshenhorn et al. | 362/147 |
| 5,390,095 | 2/1995 | Lemons et al. | 362/301 |

*Primary Examiner*—Stephen F. Husar
*Attorney, Agent, or Firm*—Quarles & Brady

[57] ABSTRACT

Disclosed herein is a light unit for narrow hallways A reflector housing is provided to project light from a vertically extending bulb in an indirect manner, so as to provide a substantially laterally extending light pattern. The reflector has internal reflecting surface surrounding the longitudinal axis of the bulb.

6 Claims, 6 Drawing Sheets

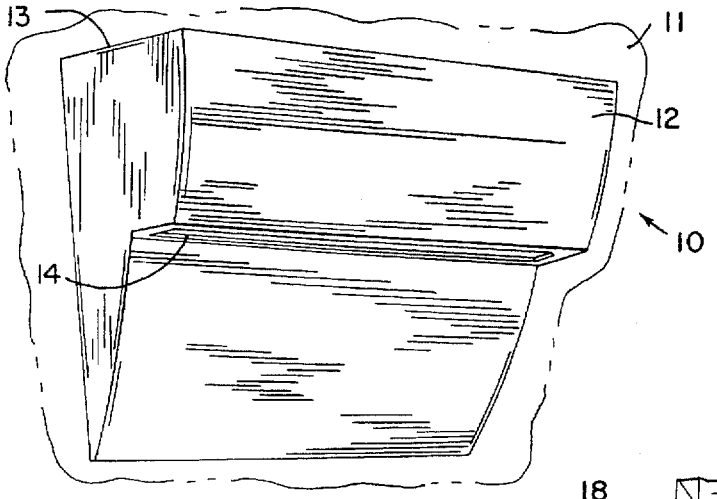
FIG. 1
FIG. 2
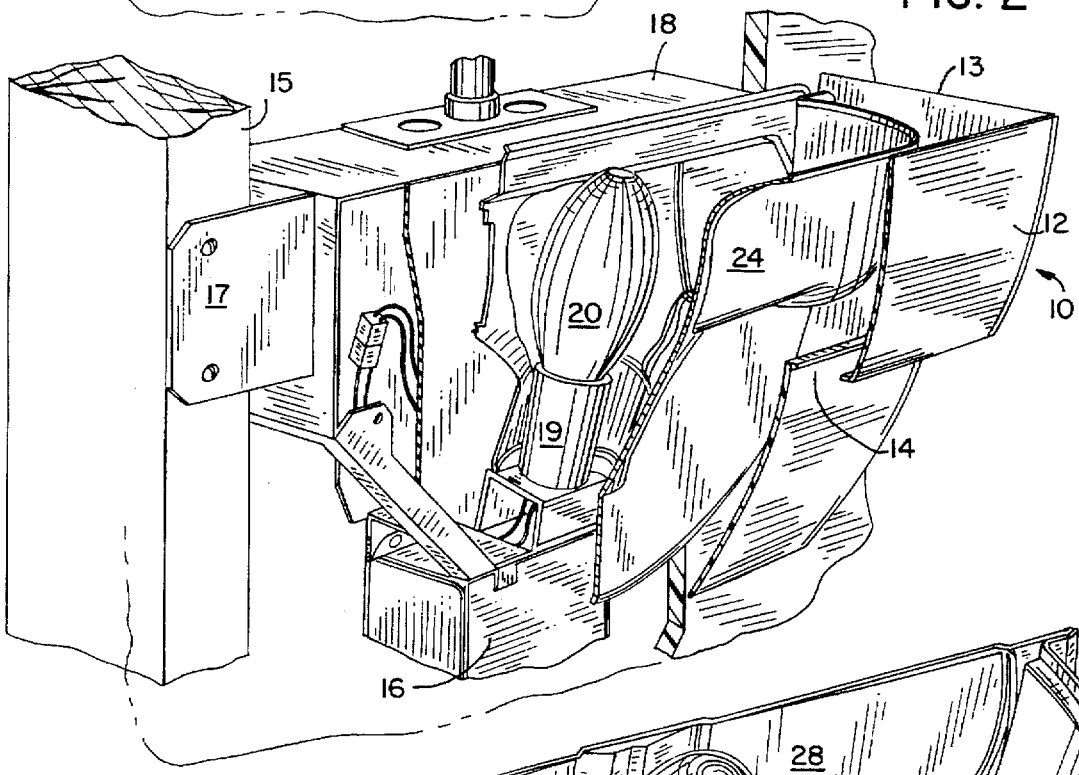
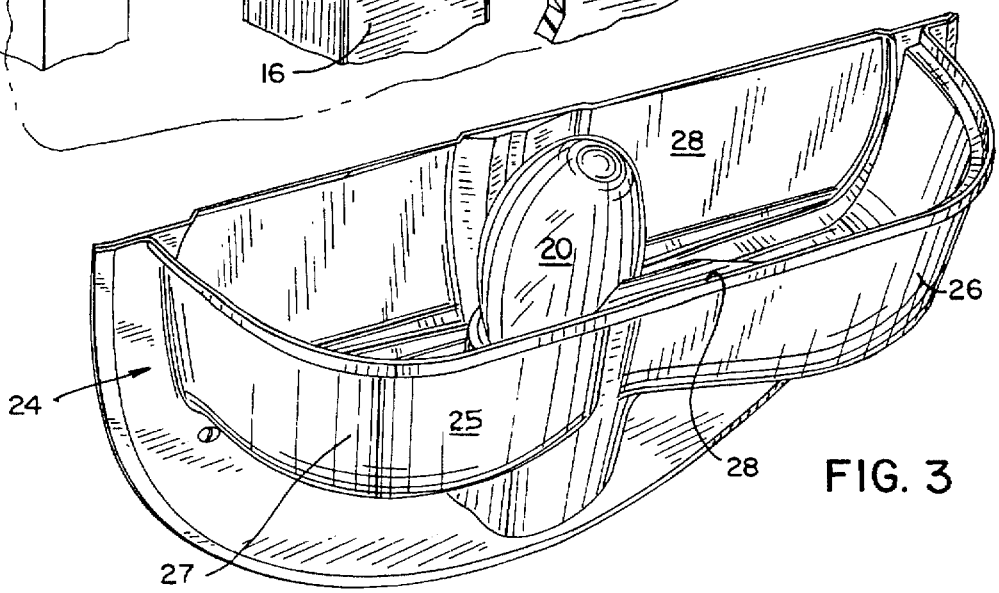
FIG. 3

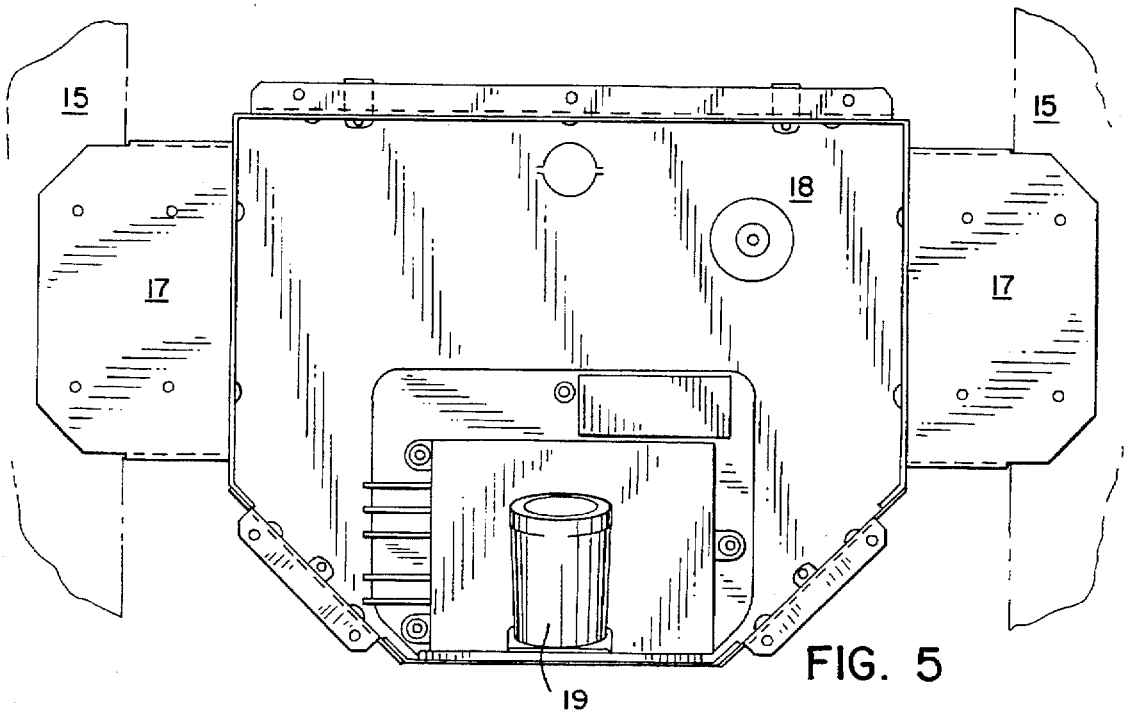
FIG. 5
FIG. 7
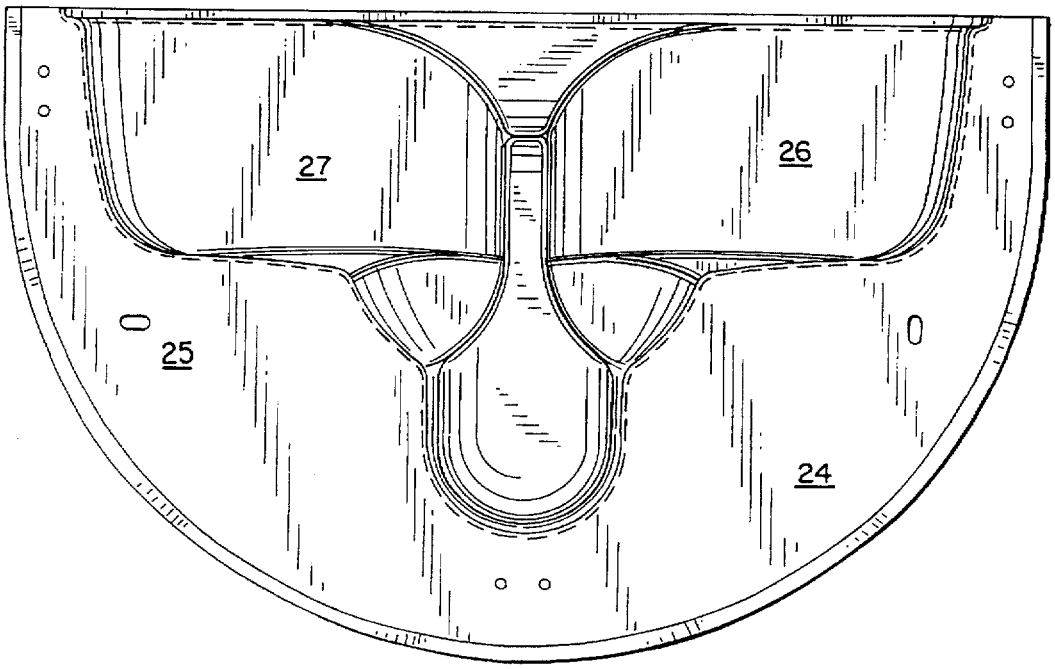

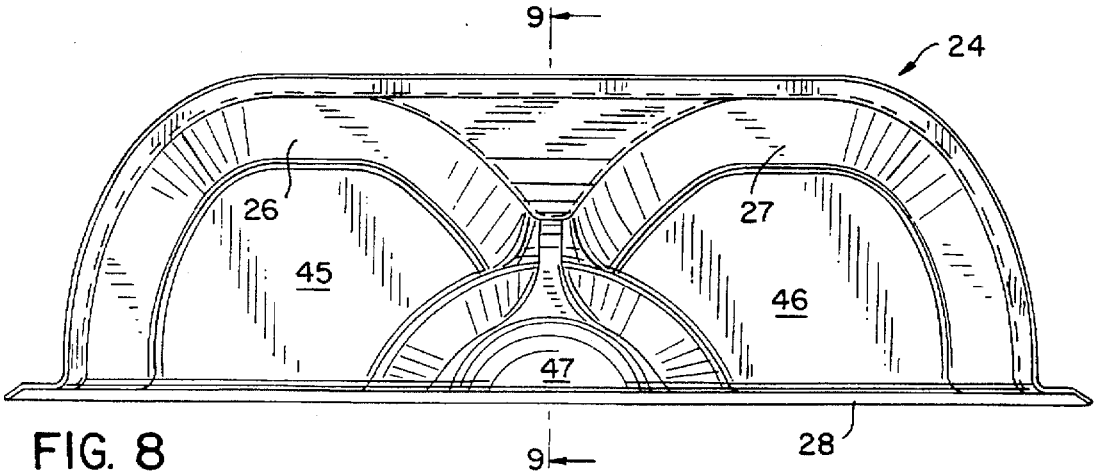
FIG. 8
FIG. 9
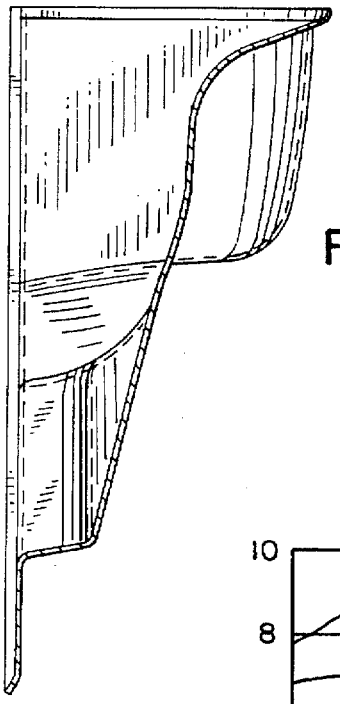
FIG. 12
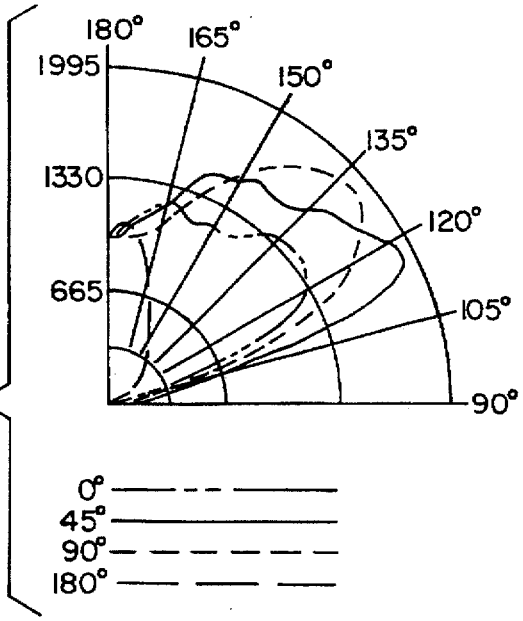
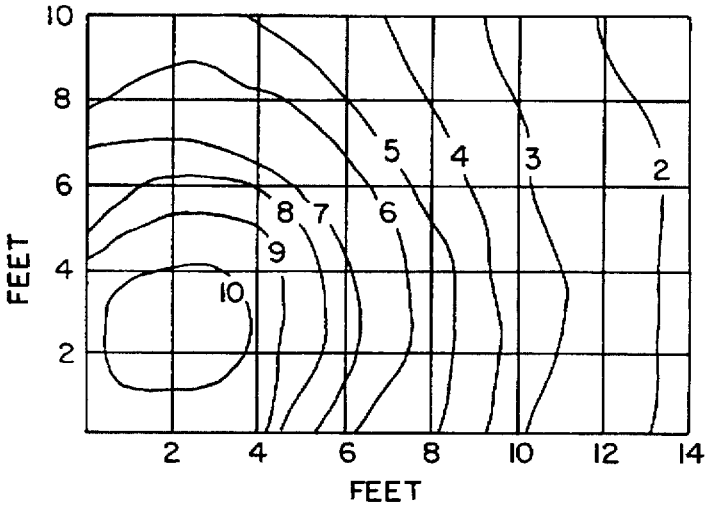
FIG. 13

WALL MOUNTABLE LIGHTING FIXTURE

TECHNICAL FIELD

The present invention relates to indirect lighting fixtures. It appears to be especially well suited for use in lighting narrow hallways.

BACKGROUND ART

The art has developed a variety of systems for lighting narrow hallways. One system uses overhead downlights. However, this solution may be difficult to implement in narrow hallways that already have low ceilings, and/or where it is desired to keep the space between floors to the minimum (for cost or other reason).

Another common system mounts lighting fixtures along the sides walls of the hallways. However, in order to obtain adequate light, such fixtures have in the past often projected significantly out from the wall. This system must now be changed due to laws and regulations (the American Disabilities Act) which limit the placement of lighting fixtures in narrow hallways where the fixtures project out more than four inches from the side walls.

If one uses conventional side wall fixtures that extend out four inches or less from the wall, one needs to use more fixtures along the wall. This increases the installation and maintenance cost, and leads to energy inefficiency. As such, a need exists for an improved lighting fixture for use in narrow hallways which does not project out more than four inches into the hallway, yet efficiently provides adequate light along the hallway.

DISCLOSURE OF THE INVENTION

In one aspect, the invention provides a lighting fixture mountable on a support. There is a reflector housing having an internal cavity defined by at least two frontal lateral lobes, a rear wall, a bottom wall and an upper opening, and an electrical lamp extending primarily vertically in the cavity.

The reflector housing bottom wall has a reflector surface positioned to reflect light from the electric lamp at least partially upward. The rear wall has a reflector surface positioned to reflect light from the electric lamp forward and also laterally. The frontal lateral lobes both have reflector surfaces positioned to reflect light from the electric lamp upward, rearward, and also laterally. Preferably, the rear wall has at least two sets of reflector segments, one set for reflecting light laterally outward, and a second set for reflecting light laterally inward across the electric lamp.

In an especially preferred form the bottom wall has an opening therethrough that is suitable to receive a light socket for accommodating a metal halide, fluorescent, or incandescent lamp, and the top of the lamp is below the top edge of the reflector housing that is directly in front of the lamp.

In other embodiments, the electric lamp has a longitudinal axis which is in an essentially vertical plane, the rear wall of the reflector is at least partially behind the front of the portion of the hallway adjacent the fixture, and the electrical lamp is linked to an electrical control such as a magnetic ballast or the like.

The fixture provides an indirect lighting system which efficiently projects a predominantly lateral lighting pattern to illuminate narrow hallways. Importantly, even light initially rearwardly or downwardly directed from the bulb is reflected out and efficiently used.

In another aspect there is also a decorative shade in front of and under the reflector, and neither the shade nor the reflector projects out into the hallway more than four inches.

Using one example form of the invention, two or more foot candles of light can be achieved all the way across a hallway for twelve lateral feet in both directions. Thus, a hallway can be illuminated with a reduced number of fixtures, without violating ADA requirements. Also, the lighting is inviting and warm, and it gives the aesthetic feel of a secure area.

The objects of the present invention therefore include providing a lighting fixture of the above kind which:

(a) has a wide, indirect light pattern whose main distribution is emitted at 115° from vertical and at +–67.5° laterally;

(b) provides for spacing distances much greater than those typical with ADA compliant wall sconces;

(c) provides evenly balanced uniform lighting consistent with Illuminating Engineering Society Of North America recommendations; and (d) efficiently uses energy.

These and still other objects and advantages of the present invention will be apparent from the description which follows. The following description is merely an example of the present embodiment. The claims should be looked to in order to appreciate the full scope of the invention.

DESCRIPTION OF THE DRAWINGS

FIG. 1 is a frontal, left, perspective view of a wall mountable lighting fixture embodying the present invention;

FIG. 2 is an enlarged, fragmented, perspective view thereof;

FIG. 3 is a reflector portion of the present invention, together with an electric light;

FIG. 5 is a front elevational view of a box for connecting electrical components;

FIG. 7 is a front elevational view of the FIG. 3 reflector;

FIG. 8 is a top plan view of the FIG. 3 reflector;

FIG. 9 is a sectional view taken on line 9—9 of FIG. 8;

FIG. 12 is a chart showing candle power distribution of the invention for one embodiment;

FIG. 13 is an isocandle curve for the FIG. 12 embodiment.

BEST MODES FOR CARRYING OUT THE INVENTION

Figure 4:
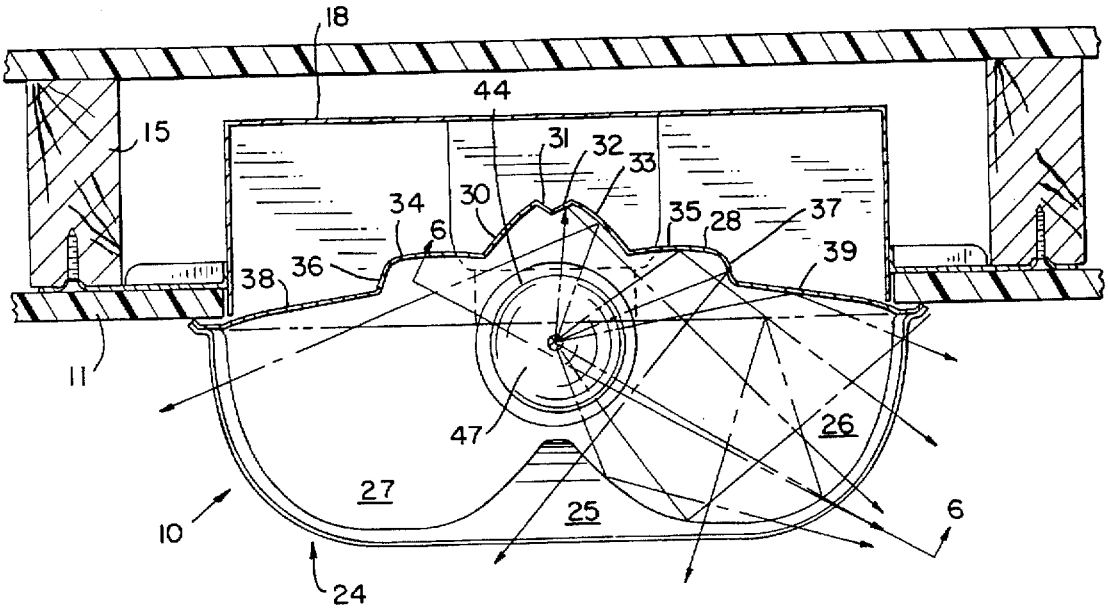
FIG. 4 is a top plan view, in partial section, of a portion of the fixture mounted on and in a hallway wall albeit with a different rear reflector.

As shown in FIGS. 1, 2 and 4, there is a lighting fixture (generally 10) mounted against (and partially in) a wall support 11. Outer decorative shade 12 has an upper opening 13 and a lower slot 14.

There are the usual wall studs 15 on to which is mounted a recessed housing 18 via brackets 17 as best seen in FIGS. 2 and 5. A conventional ballast/control 16 is mounted into the housing and provides the electrical characteristics to operate metal halide, fluorescent, or incandescent lamps or bulbs 20.

The socket 19 and bulb 20 extend into the internal cavity of reflector housing 24. The reflector is preferably made of aluminum and can be manufactured in one or two pieces. In the two piece embodiment (as shown), it consists of a front wall 25 having two opposed frontal, lateral reflecting lobes 26 and 27. In addition, there is a rear wall 29 which has a series of rear reflector lobes 30, 31, 32, and 33 (see FIG. 4). Light behind bulb 20 is reflected laterally outward from lobes 31 and 32 and laterally inward across the bulb from lobes 30 and 33.

Figure 4A:
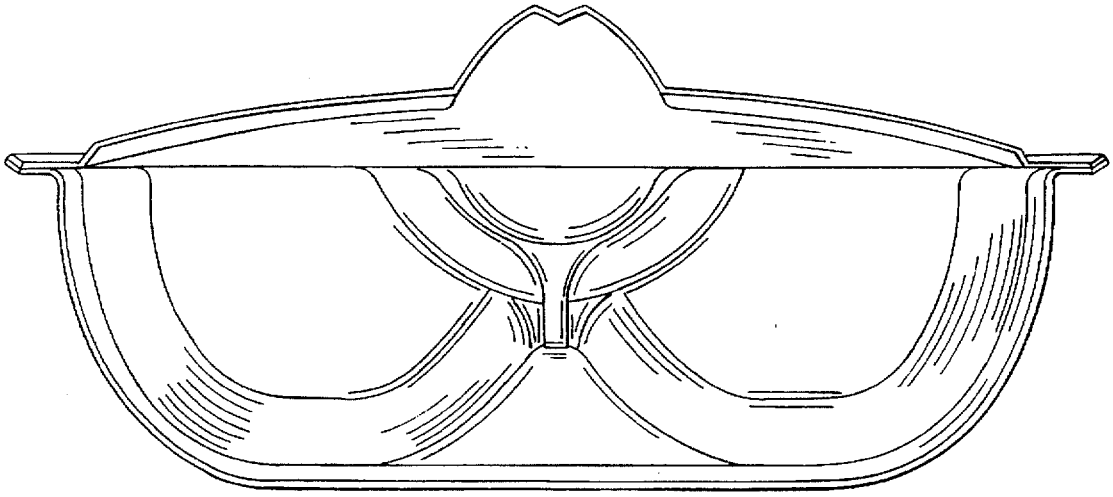
FIG. 4A is a view similar to FIG. 4, but with the FIG. 3 rear reflector.
Figure 10:
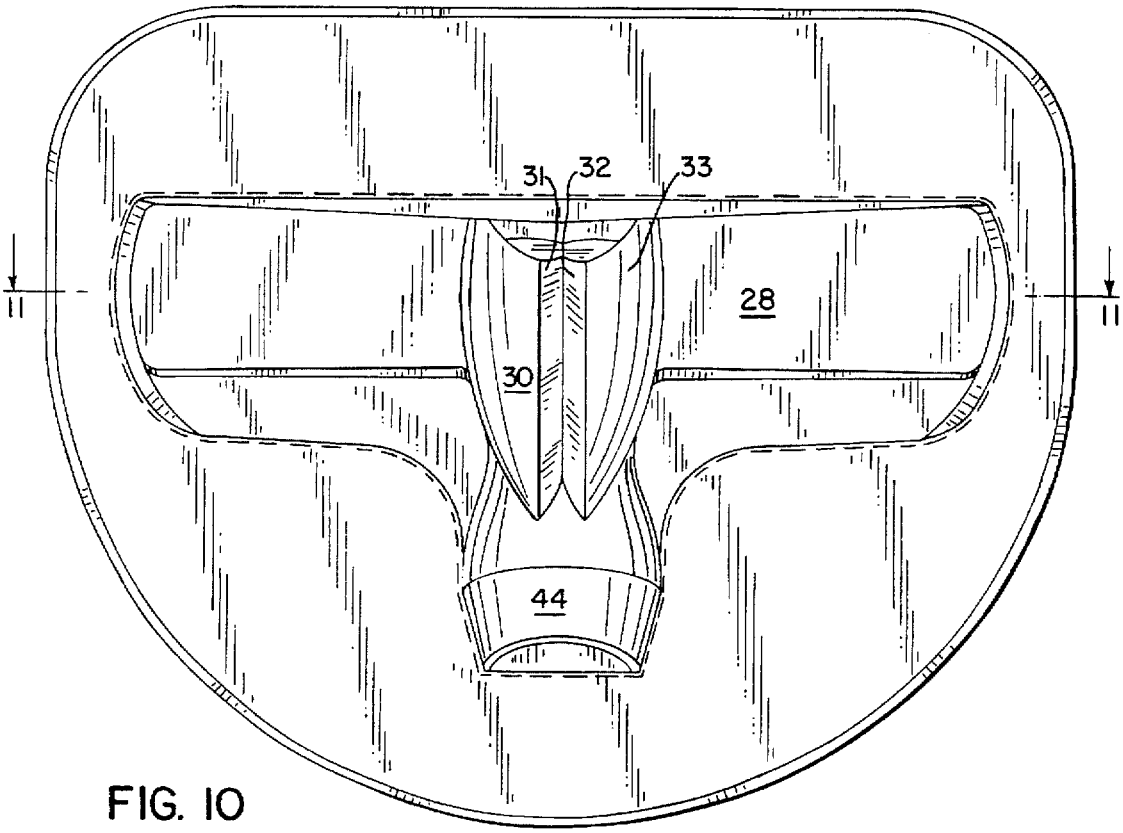
FIG. 10 is a rear elevational view of the FIG. 3 reflector.
Figure 11:
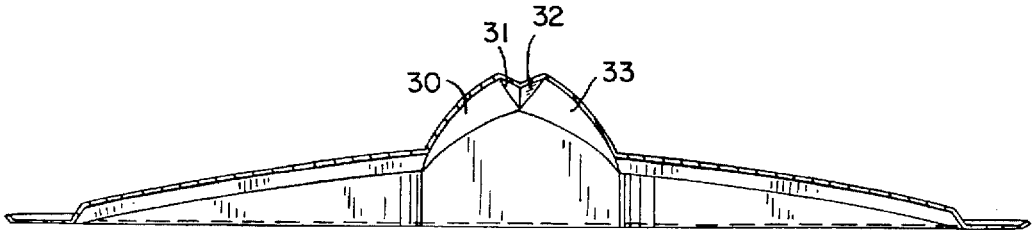
FIG. 11 is a top plan view of a rearward portion of the FIG. 3 reflector.

Also, in the FIG. 4 embodiment reflector segments 34–39 reflect some light laterally outward and some across in front of the bulb when directing light forward. The FIG. 4A reflector has a somewhat simpler shape in this region.

The bulb 20 is tilted forward 15° from vertical and is essentially vertical (e.g. its longitudinal axis 23 is substantially in a vertical plane and it is tilted less than 45°, e.g. perferably 15°, from up or down). The top of the reflector 28 directly in front of the bulb 20 extends higher than the bulb. Thus, those walking down a hallway will not normally see a glare from the bulb as the top of the fixture is typically positioned at about 6'6". The system is thus an indirect lighting system.

Figure 6:
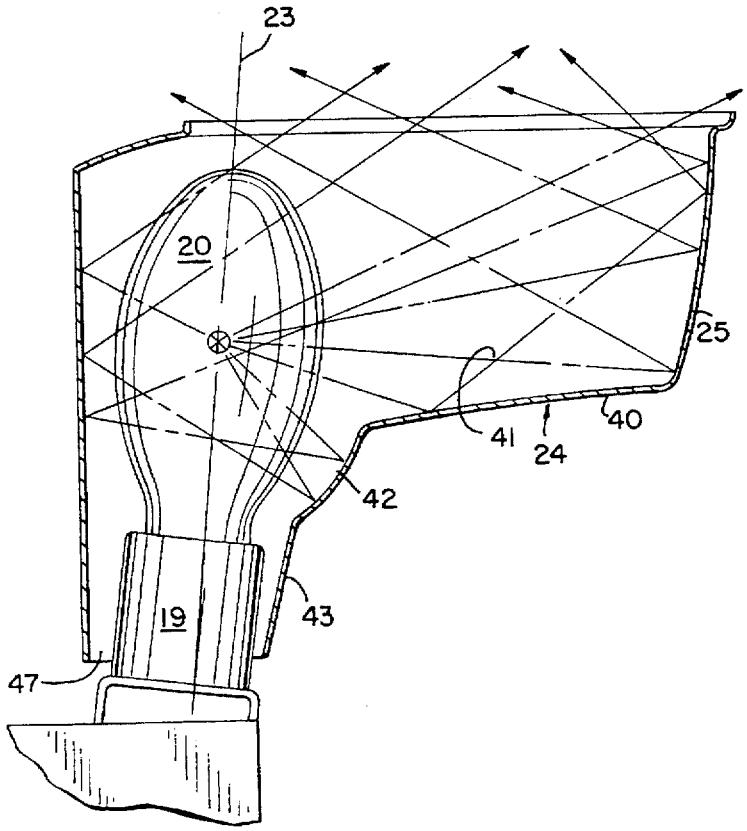
FIG. 6 is a partial sectional view taken along line 6—6 of FIG. 4.

There is also a bottom wall 40 with segments 41–46 and hole 47. As noted in FIG. 6, adjacent the bulb 20 the light is reflected up and forward. Light reaching the front lobes 26, 27 is reflected so that some of the light reflects up onto the wall, albeit most projects laterally.

Slot 14 also permits some light to be reflected down from the ceiling back through the fixture along the support.

With respect to the chart of FIG. 12, the axes are light intensities measured in candela from 90° (level with the light) to 180° (up). The patterns are 0° (dotted line) which depicts the light directed forward from the front of the fixture, 45° (solid line) representing the light projected laterally out into the hallway, 90° (medium dashed line) indicating the light projected laterally along the wall, and 180° (long dashes) which is the back light. It can be seen that the light with greatest intensity occurs at a lateral angle out into the hallway.

FIG. 13 is a top plan view with axis 2–10 being distance (feet) in a direction perpendicular across the hall and axis 2–14 being distance (feet) laterally along the hallway. Note the footcandle level twelve feet down the hallway and eight feet away from the wall. As a result, such fixtures can be positioned 24 feet apart or more, in a conventional hallway.

It will therefore be appreciated that the present invention provides a unique solution for lighting narrow hallways without the need for overhead lights, substantial projections into the hallways, or an unacceptable number of fixtures. While particular embodiments of the present invention have been described, it should be appreciated the invention is not to be limited to just these versions. Rather, other embodiments are intended to be within the scope of the invention.

For example, while the reflector and shade are shown as having an upwardly open end, a glass lens can be placed over the top of the fixture to prevent dust from entering the reflector cavity. Further, while a particular size of reflector has been shown, the upper rear edge of the reflector (along the wall) can be extended up a greater distance to provide a surface which further reflects heat and light away from the wall adjacent to the top of the reflector. This is preferred for halide bulbs of 70 watts or more.

In another alternative, the ballast system used with the lamp can have an emergency power supply which operates the lamp (e.g. for ninety minutes) on battery power if the AC power is shut off. Further, various holes can be provided in the decorative shade which can then be covered by transparent red or green inserts so as to provide a visual indication to people walking down the hallways regarding a proper emergency evacuation route.

Also, the system can be provided with a start-up lighting option, such as a 25 watt quartz lamp, that provides temporary lighting until the halide lamp reaches thirty percent of its lighting output when the system is first turned on.

It should also be appreciated that other forms of electrical light such as fluorescent bar lamps, halogen lamps or incandescent lamps can also be used. However, substantially vertically disposed bulbs are desired as primarily horizontal bulbs can yield dark spots corresponding to the location of the light socket (or require two bulbs to avoid such dark spots).

INDUSTRIAL APPLICABILITY

This invention is useful in lighting narrow hallways.

We claim:

1. A lighting fixture mountable on a support, comprising:

a reflector housing having an internal cavity defined by at least two frontal lateral lobes, a rear wall, a bottom wall and an upper opening; and an electrical lamp extending primarily vertically in the cavity;

the bottom wall having a reflector surface positioned to reflect light from said electric lamp at least partially upwards;

the rear wall having a reflector surface positioned to reflect light from said electric lamp at least partially forward; and the frontal lateral lobes having reflector surfaces positioned to reflect light from said electric lamp upward, rearward, and laterally.

2. The fixture of claim 1, wherein the rear wall has at least two sets of reflector segments, one set being suitable to reflect light laterally outward from said electric lamp and a second set being suitable to reflect light from said electric lamp laterally inward across the electric lamp.

3. The fixture of claim 1, wherein the bottom wall has a hole for receiving a light socket, and there is a frontal lower reflector surface on the reflector housing adjacent and below the lamp for reflecting light upwardly.

4. The fixture of claim 1, wherein the electric lamp has a longitudinal axis in an essentially vertical plane.

5. The fixture of claim 1, where the fixture mounted on and at least partially in the support such that the reflector rear wall is positioned at least partially behind a portion of the front surface of the support adjacent the fixture.

6. The fixture of claim 1, further comprising a decorative shade mountable forward and under the reflector housing, the shade also having an upper opening.

* * * * *

UNITED STATES PATENT AND TRADEMARK OFFICE

CERTIFICATE OF CORRECTION

PATENT NO. : 5,676,455
DATED : October 14, 1997
INVENTOR(S) : Dennis W. Johnson, et. al.

It is certified that error appears in the above-identified patent and that said Letters Patent is hereby corrected as shown below:

Column 4, line 53

Claim 5, line 1 After "fixture" --is-- should be inserted.

Signed and Sealed this

Sixteenth Day of December, 1997

Bruce Lehman

*Attest:*

BRUCE LEHMAN

*Attesting Officer*

*Commissioner of Patents and Trademarks*